US009759444B2

(12) United States Patent
Lüdi

(10) Patent No.: US 9,759,444 B2
(45) Date of Patent: Sep. 12, 2017

(54) ARRANGEMENT FOR VENTILATING A ROOM, IN PARTICULAR A LABORATORY ROOM

(75) Inventor: Hansjürg Lüdi, Dietikon (CH)

(73) Assignee: H. Luedi + Co. AG, Regensdorf (CH)

( * ) Notice: Subject to any disclaimer, the term of this patent is extended or adjusted under 35 U.S.C. 154(b) by 650 days.

(21) Appl. No.: 13/821,060

(22) PCT Filed: Aug. 27, 2011

(86) PCT No.: PCT/EP2011/004314

§ 371 (c)(1),
(2), (4) Date: Apr. 10, 2013

(87) PCT Pub. No.: WO2012/031700

PCT Pub. Date: Mar. 15, 2012

(65) Prior Publication Data

US 2013/0210336 A1 Aug. 15, 2013

(30) Foreign Application Priority Data

Sep. 7, 2010 (DE) ..... 10 2010 044 590

(51) Int. Cl.
*F24F 13/062* (2006.01)
*F24F 7/08* (2006.01)
(Continued)

(52) U.S. Cl.
CPC ..... *F24F 13/062* (2013.01); *E04B 9/006* (2013.01); *E04B 9/02* (2013.01); *F24F 7/08* (2013.01);
(Continued)

(58) Field of Classification Search
CPC ..... F24F 13/068; F24F 2013/0608
See application file for complete search history.

(56) References Cited

U.S. PATENT DOCUMENTS 2,833,199 A * 5/1958 Wakefield ..... E04B 9/02 454/297
3,159,090 A * 12/1964 Schutt ..... E04B 9/04 454/270
(Continued)

FOREIGN PATENT DOCUMENTS

BE 1010482 A7 10/1998
DE 2721434 A1 * 11/1978
(Continued)

OTHER PUBLICATIONS

Kessler & Luch GmbH, DE2900575 A1 English machine translation, Jul. 17, 1980.*
(Continued)

*Primary Examiner* — Alissa Tompkins
*Assistant Examiner* — Phillip E Decker
(74) *Attorney, Agent, or Firm* — Laurence A. Greenberg; Werner H. Stemer; Ralph E. Locher

(57) ABSTRACT

An arrangement for ventilating a room contains a supply air duct arranged above an aisle region for delivering air into a room and, arranged above the supply air duct, an exhaust air duct for discharging exhaust air. The supply air duct contains two lateral air delivery portions which extend along the aisle region and each contain air outlet openings from which the supply air exits laterally. A substantially airtight central separating portion separates the first and the second air delivery portions from one another. The exhaust air duct contains two slot-like suction openings which extend substantially parallel to the supply air duct and are arranged in the ceiling such that there is formed on both sides of the aisle region a rolling air flow via which supply air heated in the region of work tables passes in a vertical direction into the region of the ceiling.

11 Claims, 3 Drawing Sheets

(51) Int. Cl.

| | |
|---|---|
| ***E04B 9/00*** | (2006.01) |
| ***E04B 9/02*** | (2006.01) |
| ***F24F 13/068*** | (2006.01) |
| *F24F 13/06* | (2006.01) |

(52) U.S. Cl.
CPC .... *F24F 13/068* (2013.01); *F24F 2013/0608* (2013.01); *F24F 2221/14* (2013.01)

(56) References Cited

U.S. PATENT DOCUMENTS

| | | | | |
|---|---|---|---|---|
| 3,824,909 | A * | 7/1974 | Horneff | E04B 9/02 454/187 |
| 4,023,472 | A * | 5/1977 | Grunder | F24F 13/068 454/338 |
| 5,490,813 | A | 2/1996 | Danielsen et al. | |
| 6,280,320 | B1 * | 8/2001 | Paschke | F24F 13/0218 454/296 |
| 6,602,129 | B1 * | 8/2003 | Sokolean | F24F 13/068 454/187 |
| 7,836,662 | B2 | 11/2010 | Luedi | |
| 2002/0155805 | A1 * | 10/2002 | Paschke | F24F 13/0218 454/293 |
| 2005/0252237 | A1 * | 11/2005 | Sokolean | F24F 5/0017 62/515 |
| 2008/0202050 | A1 * | 8/2008 | Ludi | E04B 9/006 52/302.1 |
| 2010/0119029 | A1 | 5/2010 | Viallon et al. | |
| 2016/0334120 | A1 * | 11/2016 | Hagstrom | F24F 13/06 |

FOREIGN PATENT DOCUMENTS

| | | | |
|---|---|---|---|
| DE | 2900575 | A1 * | 7/1980 |
| DE | 40 22 392 | A1 | 1/1992 |
| DE | 10 2010 044 590 | A1 | 3/2012 |
| FR | 2 915 272 | A1 | 10/2008 |
| WO | 93/15366 | A1 | 8/1993 |
| WO | 2007/033821 | A1 | 3/2007 |
| WO | 2012/031700 | A1 | 3/2012 |

OTHER PUBLICATIONS

Keyser, BE 1010482 A7 English machine translation, Oct. 6, 1998.*
Kiesel, DE2721434A1 English machine translation, Nov. 16, 1978.*

* cited by examiner

ARRANGEMENT FOR VENTILATING A ROOM, IN PARTICULAR A LABORATORY ROOM

BACKGROUND OF THE INVENTION

Field of the Invention

The invention relates to an arrangement for ventilating a room, in particular a laboratory room, according to the claims.

Building technology makes use, for the ventilation of research laboratories, for example, for chemical or physical research, of ceiling constructions in which the lines for air supply, air discharge and the technical gases required in the laboratory, liquids, electrical power and data lines, etc., are arranged on a carrier frame which is mounted on the building ceiling.

From WO 2007/033821, it is known in this context to secure the supply air channel for the supply of fresh air and the discharge air channel which is arranged over it above the passage region to a carrier frame, the supply air channel extending in the plane of the carrier frame and being occupied with swirl nozzles, from which the generally cooled supply air is locally discharged. The fresh air being discharged is provided with a strong rotation impulse and induces in the region of the centre of the swirl nozzle a large quantity of ambient air which is subsequently thrown to the side and leads to significant mixing of supply air and ambient air. This mixing ensures that the temperature and also the contaminants present are evenly distributed in the entire room in a short space of time. Draughts are thereby very easily produced; they are occasionally perceived by the users of the laboratory to be disruptive and often lead to impairment of health.

From DE 10 2010 006 360 A1 which was not previously published, it is further known to configure the supply air channel as a textile channel which is provided with microperforations and which is in the form of a horizontal "D" in cross-section and which is secured with the flat side to the lower side of the carrier frame. Although the risk of draughts of air, in particular at high air exchange rates of more than 8 air changes per hour and comparatively low supply air temperatures with respect to the ambient air, is significantly reduced compared with otherwise conventional arrangements owing to the perforation which is formed over a large area, the perforation of the textile channel over the entire cross-sectional width thereof involves the problem that the cool supply air is mixed with warm ambient air not only in the passage region, but also in the region of the work tables.

To be precise, with the textile, spring-like or laminar outlets described above, regardless of their form, an inverted droplet form of the discharged cold air is produced directly below the outlet. The fresh air thereby accelerates rapidly downward in a narrow band and reaches output speeds which, at the air exchange rates and supply air temperatures required in laboratories, lead to speeds which are far beyond the permissible maximum values and are perceived as a draught of air by the laboratory assistants.

BRIEF SUMMARY OF THE INVENTION

Accordingly, an object of the present invention is to provide an arrangement for ventilating a room, in particular a laboratory room, by means of which the risk of the occurrence of an air draught can be reduced and the energy costs required to operate the arrangement can be reduced.

This object is achieved according to the invention by the features of the independent claims. Other features of the invention are described in the dependent claims.

According to the invention, an arrangement for ventilating a room, in particular a laboratory room, which has a passage region which is delimited at both sides by work tables, comprises a supply air channel which is arranged above the passage region and which is for supplying into the room preferably cooled fresh air, which is also referred to below as supply air. The supply air channel has a plurality of air discharge openings, from which the supply air is discharged above the passage region. At a spacing of, for example, from 0.8 m to 1.5 m, there is arranged above the supply air channel a discharge air channel which, in the same manner as the supply air channel, preferably extends along the vertical centre plane of the passage region and discharges the used discharge air which is heated with respect to the supply air from the room.

The supply air channel has two lateral air supply portions which are preferably constructed as strips and which extend along the passage region and which each have a plurality of circular air discharge openings which are preferably formed as a perforation, for example, using a laser or the like, into the air supply portions and from which the supply air is preferably discharged exclusively in a lateral direction, that is to say, obliquely at an angle relative to the vertical centre axis of the passage region, in the direction of the work tables. The two lateral air supply portions are spaced apart from each other by means of a substantially air-impermeable central partition portion, the longitudinal centre axis of which preferably extends along the centre plane of the passage region and which separates the first and the second air supply portion from each other.

In the arrangement according to the invention, the discharge air channel has two slot-like suction openings which extend substantially parallel with the supply air channel and which are arranged in the region of the building ceiling of the room at the highest possible location.

The size and the number of the hole discharge openings arranged in the two lateral air supply portions and the width of the partition portion and the size and shape of the air suction openings of the suction air channel are selected according to the invention in such a manner that, at both sides of the passage region, there is formed an air roll or an air vortex whose centre is preferably located approximately in the region of the passage-region-side edge of the work tables and preferably at the height of half the distance between the supply air channel and the floor.

In the preferred embodiment of the invention, the supply air channel comprises a thin, preferably light-permeable membrane having low air-permeability, for example, comprising a plastics-coated textile fabric. The supply air channel preferably extends in this instance over the entire length of the passage region of the laboratory and may, in the case of a plurality of successively arranged laboratory workspaces, also preferably extend over the entire length of the central passages of all the laboratories. The perforation which is preferably formed as a microperforation having a hole size in the range between 0.1 mm and 1 mm, preferably from 0.4 mm to 0.6 mm and particularly preferably of 0.5 mm, in the material of the supply air channel which is per se substantially air-impermeable is interrupted in the region of the central partition portion to form the partition portion. The arrangement of the air discharge openings of the microperforation is advantageously carried out in rows transversely relative to the longitudinal axis of the passage region with a spacing of from one to a few cm, preferably 2 cm. Within a row, the air discharge openings in the preferred embodiment of the invention have a spacing of approximately 4 mm, which results in a standard laboratory in an air exchange rate relative to the surface-area in the range from 12.5 to 37.5 $m^3/m^2/h$, which approximately corresponds to from 4 to 12 times the air exchange rate in a standard laboratory.

The invention has the advantage that the quantity of supplied supply air can be very easily modified by changing the number and diameter of the air discharge openings in the lateral air supply portions so that the air exchange rates, in particular with supply air channels which are already installed, can be increased in a very cost-effective manner by forming a corresponding number of additional holes or slots in the air supply portions in order, for example, retrospectively still to be able to take into account a changed use of the laboratory.

The arrangement of the microperforations in two lateral strips produces a discharge impulse which, as a result of the strip arrangement, permits a microinduction at the individual holes and, even in the direct vicinity of the discharge region of an air discharge opening, thus mixes the cooler supply air with a specific quantity of warm ambient air which advantageously leads to the output speed of the air being discharged being reduced. The discharged supply air is subsequently combined to form, after only a short distance, substantially at the centre of each air discharge opening, an individual downwardly directed wide air jet. As a result of the warm ambient air which has been previously induced, that is to say, mixed with a supply air jet which is discharged from an air discharge opening, this air jet falls only slowly to the floor, whereby the discharge speeds of the supply air occurring in the passage region, depending on the air exchange rate and supply air temperature, are between 0.20 m/s and max. 0.25 m/s. Since the previously mentioned values, even at very high air exchange rates and low supply air temperatures, as required, for example, for air conditioning of a laboratory in the summer, are advantageously below those speeds which are perceived by individuals as draughts of air, the use of the arrangement according to the invention in the passage region results in consistently climatically pleasant working conditions in the passage region.

The supply air which is discharged from the air discharge openings and which is partially mixed with warm ambient air falls as mist over the entire passage length and also, with a correspondingly selected width of the supply air channel, over the entire width of the passage region in the direction toward the floor. Depending on the desired air exchange rate, a portion of the supply air is diverted at the edges of the work tables to the left and to the right of the passage over the table panels, whereas the majority of the fresh air supplied flows toward the floor of the passage region and is divided there to the right and to the left.

Owing to the laboratory layouts generally used in laboratory rooms, in which the electrical devices and other heat sources are generally located at the left-hand side and at the right-hand side of the passage region above or below the work tables, as a result of these heat sources there is produced over the work tables an upward flow which is powerful in comparison with the comparatively weak downward flow of the supplied supply air in the passage region and which ensures that the used ambient air which is located over the table panels of the work tables is correctly drawn away and rises upward in the direction toward the building ceiling. This strong upward flow in the region of the heat sources over and also behind the work panels of the work tables extends as far as a location directly below the ceiling of the room, where it is redirected in the direction toward the discharge air channel and is drawn away by the lateral suction slots.

There are thereby produced two opposing air rolls, the left air roll of which when viewed in the longitudinal passage direction rotates in a clockwise direction and the right air roll of which when viewed in the longitudinal passage direction rotates in a counter-clockwise direction. Owing to the air rolls which are produced in each case, consequently, the ambient air heated locally over the work tables and also the ambient air warmed by the persons in the passage region is transported in a very narrow region and at very high speed substantially directly in a vertical direction into the region above the supply air channel and is discharged from the room via the suction slots of the discharge air channel without being mixed with the supplied cooler supply air in the passage region.

The discharge air channel is installed with spacing of preferably from 2 to 5 cm below the building ceiling, that is to say, the ceiling of the room which generally comprises concrete and which is generally located at a height of, for example, 2.8 m or 3 m above the floor of the passage region. The suction openings are located in this instance at the upper side of the discharge channel and are configured in such a manner that a substantially constant reduced pressure is produced over the entire length of the discharge channel between the building ceiling and the channel. This may be carried out, for example, by the slot-like air suction openings of the suction channel increasingly expanding in the direction away from the extractor fan, or the number and/or the diameter of air suction holes which are introduced locally in the slot-like suction openings being increased in the direction away from the extractor fan.

As a result of the arrangement and configuration of the discharge air channel, the discharge of the used ambient air is carried out at the absolutely highest possible location in the room and preferably also over the greatest possible length of the passage region.

With respect to mixed ventilation with swirl nozzles, in which there is a substantially homogeneous temperature distribution of the air in the entire room, the arrangement according to the invention has the advantage that the warm discharge air and the cool supply air within the room are supplied and discharged in different regions which are substantially separated from each other without significant mixing of the cool supply air and the discharge air which has been warmed by the heat sources and the persons within the passage region. As a flow simulation based on a standard laboratory has shown, at an average temperature of 22.5° C. in the passage region directly above the room ceiling in the region of the suction slots there is an air temperature of 30° C. which is produced by the air above the heat sources on the work tables rising substantially vertically at a high flow speed and accumulating directly below the building ceiling. This separation of cool and slow supply air in the passage region below the supply air channel and, with respect to this, comparatively hot air in the region above the heat sources and at the height of the suction openings, allows the thermal efficiency during the air conditioning of a room to be considerably increased.

As a result of this thermal layering of the air in the room described above, with the solution according to the invention not the entire room, but only the occupied zone in the passage region is temperature-controlled by the cool air. The zone above the supply air channel, which is generally received on a carrier frame which is also referred to below as a ceiling grid, has almost no influence on the temperature control of the air in the occupied zone. The temperature of the discharge air which, in conventional systems in which the entire ambient air is substantially completely mixed with the supply air locally supplied via swirl nozzles, is in the range from 23° C. to 25° C., has with the arrangement according to the invention a temperature which is approximately 5° C. higher, that is to say, is approximately from 28° C. to 30° C. As a result of the greater temperature difference between supply air and discharge air compared with a mixed ventilation system of the prior art, the volume of air flow required for the heat discharge from the room—and therefore the energy consumption for the air supply—is smaller.

A further reduction of the energy consumption is achieved with the arrangement according to the invention in that the outer surface of the supply air channel is cooled by the supply air itself and acts in the room similarly to a cooling sail by absorbing heat from the room by means of thermal radiation and free convection. However, this advantageous effect, which also occurs in principle with other thermally non-insulated supply air channels, is significantly less evident with the arrangement according to the invention as a result of the comparatively large surface of the supply air channel, in particular when it comprises a thin-walled textile material. It contributes to dissipating the heat from the room with a lower risk of draughts of air than with known ventilation systems. In particular, with the solution according to the invention the so-called perceived temperature (mean value of the air temperature and radiation temperature) in the region occupied by the laboratory assistants is favorably influenced. The air temperature in the occupied region may thereby be slightly higher in the arrangement according to the invention than with known mixed ventilation systems, whereby the air volume flow and consequently ultimately the energy consumption can again be reduced.

In a standard laboratory, using the arrangement according to the invention the demand for electrical energy which is required to produce and supply the cooled supply air can thus be reduced by up to 20% or even more compared with a known mixed ventilation system.

Another advantage which is achieved with the arrangement according to the invention is that, in the case of a local occurrence of contaminants, for example, when a fluid which is harmful to health is discharged on one of the work tables, the entire contaminant concentration in the room can be reduced by more than 25% compared with a mixed ventilation. This is because the air which is charged locally with contaminants above the work tables is directed directly by the two air rolls previously mentioned into the region of the building ceiling and from there to the suction slots of the discharge channel. In other words, contaminants which are discharged locally over the work tables are not mixed with all of the ambient air, as is the case with air conditioning systems of the prior art, but instead the materials which are harmful to health are conveyed out of the occupied zone directly above the work tables directly to the building ceiling in the region above the supply air channel and are removed from the room there via the discharge openings of the discharge air channel.

Since, in existing ventilation systems of the prior art, an air exchange rate of more than eight air changes per hour is set out for safety reasons, in order to ensure a corresponding reduction of the contamination concentration with a local discharge of materials which are harmful to health, as a result of the clearly lower mixing of the vapors produced by the materials which are harmful to health with the air in the work region, as a result of the use of the arrangement according to the invention, the number of air exchanges per hour can be reduced by a corresponding amount, that is to say, for example, by 50%, with respect to the air conditioning devices of the prior art.

Conversely, however, this means that, with a predetermined air exchange rate of, for example, eight air exchanges per hour, the safety within a laboratory is increased accordingly by the use of the arrangement according to the invention, so that, in the event of the discharge of materials which are harmful to health, the exposure of the personnel working in the occupied region is significantly reduced in comparison with laboratories having mixed ventilation.

Another advantage of the arrangement according to the invention is produced by the solution according to the invention being able to be adapted in a very flexible manner to various laboratory configurations. For instance, in order to configure the ventilation of a laboratory building, the ventilation and cooling power is generally determined based on user data which may, however, be a problem when such user data are not yet known in detail at the outset in the case of a rough configuration of large laboratories. Almost the only possibility of dissipating additional thermal loads which are produced beyond a threshold value with a final configuration of the laboratory involves using in the known systems additional recirculation air coolers which are, however, expensive both to purchase and to maintain and, as a result of the reduced temperature or the increased air throughput of supplied air, further very quickly lead to the occurrence of disruptive air draughts.

With the arrangement according to the invention, it is also accordingly subsequently possible to install at almost any desired location in the room to the right and to the left of the passage region as required additional air discharge connections having other extractors, foodstuffs, hot-spot extractors, device housings, etcetera. It is thereby advantageously ensured that the heat discharged from the heat sources is not discharged into the laboratory room, but instead reaches the discharge air channel directly. To this end, from a main discharge air channel in which the discharge air channel branches above the passage region at a right angle, there may be provided parallel therewith one or two blind discharge air channels which preferably extend above the end of the work panels of the work tables remote from the passage. Using these, the hot-spot extractors, etcetera, can also subsequently be guided down over the work tables at the desired locations.

In the preferred embodiment of the invention, the supply air channel comprises a fitting piece which is preferably arranged in front of the volume flow controller for the supply air channel and which can be replaced by one or two or more heat-exchangers. This affords the advantage that, in a simple and cost-effective manner, an additional cooling power of up to 2.5 kW/h can subsequently be installed along a laboratory axis. The maximum value of additionally installed cooling power is dependent on the temperature of the supply air and the relative humidity thereof.

According to another notion forming the basis of the invention, the cooling power supplied to the room can be increased even further by an additional cooling member—also referred to as a "cooling baffle" below—being suspended at both sides of the supply air channel so as to be displaceable on the carrier frame parallel with the centre axis of the room, preferably transversely relative to the centre axis. The suspension of the cooling baffles is carried out in such a manner that they are arranged at a spacing of, for example, 10 cm beside the supply air channel, preferably flush with the lower side thereof, so that as a result of the opening which is produced between the supply air channel and each cooling baffle, a corresponding amount of ambient air can be induced from the region above the supply air channel, that is to say, can be carried along by the supply air. In addition, as a result of the transverse displaceability of the cooling baffles, it is possible to access the upper side of the supply air channel, which allows operations to be carried out on the sanitary and electrical installations which preferably extend above the supply air channel, without having to disassemble the supply air channel beforehand.

The invention will be described below with reference to the drawings and a preferred embodiment of the invention.

In the drawings:

DESCRIPTION OF THE INVENTION

Figure 1:
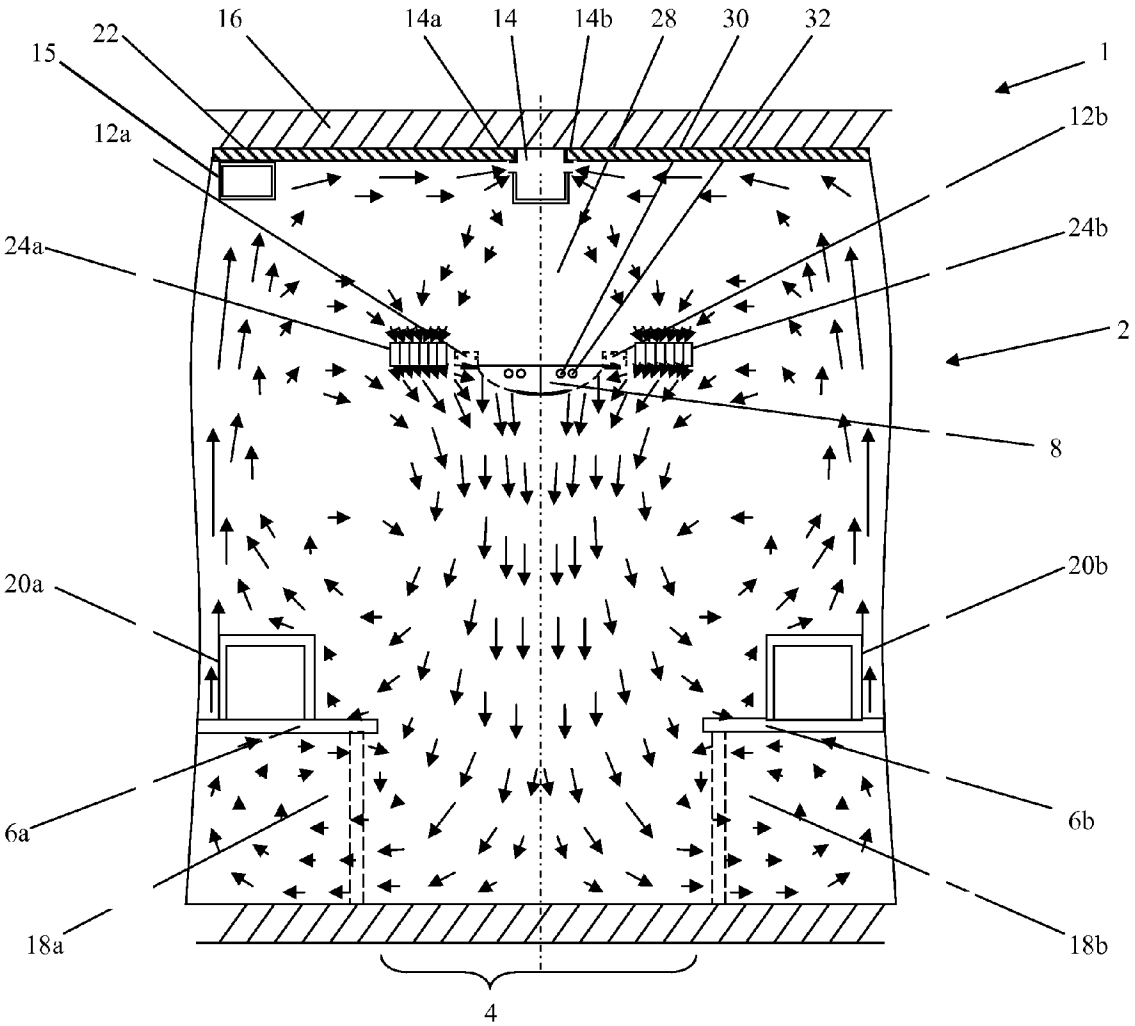
FIG. 1 is a schematic cross-sectioned view of a laboratory room with a ventilation arrangement according to the invention.

As shown in FIG. 1, an arrangement 1 according to the invention for ventilating a room 2, in particular a laboratory room, which has a passage region 4 which is delimited at both sides by work tables 6*a*, 6*b*, comprises a supply air channel 8 which is arranged above the passage region and by means of which fresh air which is preferably cooled is supplied from a fresh air generator (not illustrated in greater detail) or a fresh air fan. The supply air channel 8 has two lateral air supply portions 8*a*, 8*b* which extend along the passage region 4 and which each have a plurality of circular air discharge openings 10*a*, 10*b*, from which the supply air is discharged laterally in the direction of the work tables 6*a*, 6*b*. The two lateral air supply portions 8*a*, 8*b* are separated from each other by a substantially air-tight central partition portion 8*c*, which has, for example, ⅓ of the width of the supply air channel 8 and which has no air discharge openings. In the embodiment of the invention shown in FIG. 1, the supply air channel 8 comprises a flexible textile material, which is substantially air-impermeable and which has the cross-sectional shape of a suspended D which is received on two spaced-apart carriers 12*a*, 12*b* of a carrier frame which is not otherwise shown in detail. Above the flat portion of the D-shaped supply air channel 8 which is clamped and preferably tensioned in associated longitudinal grooves of the carriers 12*a*, 12*b*, according to the invention there are guided media lines 30 for, for example, water, gas, electrical power, etc., which are supported, for example, by a cross-member (not described in greater detail) and which are accessible from the side.

The air discharge openings 10*a*, 10*b* are in this instance formed as a microperforation having in particular circular air discharge openings 10*a*, 10*b* in the air supply portions 8*a*, 8*b* and the partition portion 8*c* is produced by the substantially air-impermeable flexible textile material in this strip-like partition portion 8*c* being left non-perforated.

The openings of the microperforation, which are preferably formed prior to the assembly of the supply air channel 8 using a laser or a suitable punching device in the lateral air supply portions 8*a*, 8*b*, have in the preferred embodiment of the invention a diameter in the range between 0.3 and 0.7 mm, preferably from 0.4 to 0.6 mm and in a particularly preferred manner of 0.5 mm. However, the air discharge openings may also have an elongate or oval shape.

The material of the supply air channel 8 may at least partially comprise a light-permeable material, a light source 32 being arranged within the supply air channel 8 in order to illuminate the room 2 in this instance.

Figure 2:
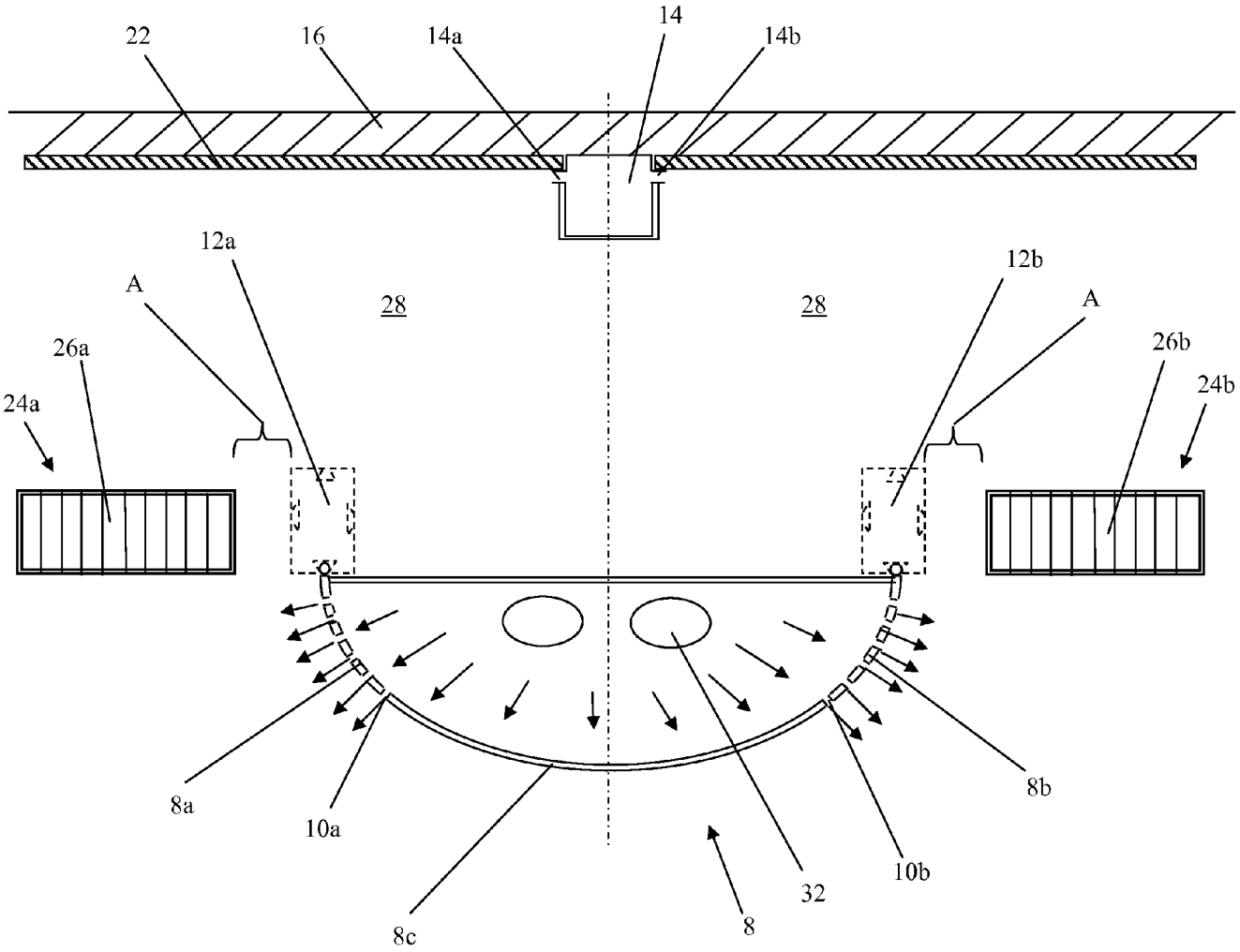
FIG. 2 is an enlarged detailed view of the supply air channel and discharge air channel of a ventilation arrangement according to the invention.

Above the supply air channel 8, there is arranged with a spacing of, for example, 80 cm to 1 m, an exhaust air channel 14 which comprises two slot-like suction openings 14*a*, 14*b* which extend substantially parallel with the supply air channel 8 and which are arranged in the region of the ceiling 16 of the room 2 in such a manner that there is formed at each of the two sides of the passage region 4 an air roll 18*a*, 18*b* which conveys the warm air produced in the region of the work tables 6*a*, 6*b* by means of heat sources 20*a*, 20*b*, such as, for example, screens, electrical operating devices or cooking devices, etc., in a vertical direction into the region of the ceiling 16 of the room 2, from where it is redirected in the direction of the suction openings 14*a*, 14*b* and is drawn therein by means of a fan which is not illustrated in greater detail, as indicated by the arrows in FIGS. 1 and 2 which are not described in greater detail.

Figure 3:
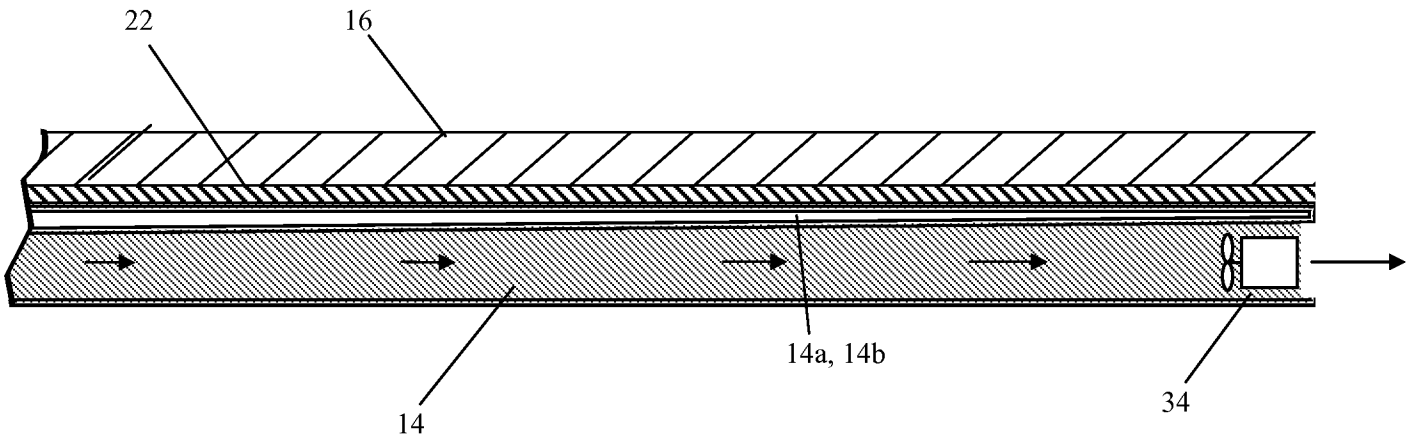
FIG. 3 is a detailed view of the discharge air channel at a fan side end.

In order to produce a substantially constant reduced pressure at the suction openings 14*a*, 14*b* preferably over the entire length of the passage region 4, the suction openings 14*a*, 14*b* of the discharge air channel 14 that are preferably constructed as longitudinal slots expand from the fan-side end 34 of the channel toward the end thereof which in the preferred embodiment of the invention is closed only with respect to the influx of air by means of a closure piece or closure sheet (see FIG. 3).

As can be further seen from the illustration of FIG. 1, there are received in the ceiling 16 of the room plate-like sound-absorbing elements 22, for example, known hard foam material or wooden panels, which have an aperture which is not illustrated and which preferably extend down from the ceiling 16 of the room as far as the suction openings 14*a*, 14*b* of the discharge air channel 14 so that the top edge of the respective suction slot 14*a*, 14*b* terminates flush with the lower side of the sound-absorbing element or extends a few cm below the lower side of the elements 22. Not only does this produce very efficient and cost-effective sound-damping in the room 2, since the elements 22 can be mounted directly on the ceiling 16 without a separate carrier construction, but it is also ensured that the discharge air can substantially enter the suction openings 14*a*, 14*b* without the flow being impeded.

In the preferred embodiment of the invention, with a predetermined spacing A of, for example, 10 cm at both sides of the supply air channel 8, there is arranged a cooling member 24*a*, 24*b*, through which a cooling medium, in particular cooling water, which is supplied via one or more of the media lines 30 flows, and which has a plurality of cooled air passage openings 26*a*, 26*b* through which air is directed from the region 28 above the supply air channel 8 in the direction toward the floor of the passage region 4.

It is possible to install at almost any desired location in the room to the right and to the left of the passage region as required additional air discharge connections 15 having other extractors, foodstuffs, hot-spot extractors, device housings, etcetera, see FIG. 1. To this end, from a main discharge air channel 14 in which the discharge air channel branches above the passage region at a right angle, there may be provided parallel therewith one or two blind discharge air channels 15 which preferably extend above the end of the work panels of the work tables remote from the passage.

LIST OF REFERENCE NUMERALS

1 Arrangement
2 Room
4 Passage region
6*a*, 6*b* Work table
8 Supply air channel
8*a* Air supply portion
8*b* Air supply portion
8*c* Partition portion
10*a*, 10*b* Air discharge opening
12*a*, 12*b* Carrier
14 Discharge air channel
14*a*, 14*b* Suction opening
16 Ceiling
18*a*,18*b* Air roll
20*a*,20*b* Heat sources
22 Sound-absorbing elements
24*a*,24*b* Cooling member
26*a*,26*b* Air passage openings
28 Region
30 Media lines
32 Light source
A Spacing

The invention claimed is:

1. A configuration for ventilating a room having a passage region which is delimited at both sides by work tables, the configuration comprising:

a supply air channel, disposed above the passage region and following a vertical central plane of the passage region, for supplying fresh air into the room, said supply air channel having first and second lateral air supply portions extending along the passage region and each having a plurality of circular air discharge openings formed therein from which a supply air is laterally discharged in a direction of the work tables, said supply air channel further having a substantially air-tight central partition portion disposed between and separating said first and second lateral air supply portion from each other; and a discharge air channel and an extractor fan communicating with said discharge air channel, said discharge air channel being disposed completely above and over said supply air channel and following the vertical central plane of the passage region for discharging discharge air from the room, said discharge air channel having slot-shaped, lateral suction openings formed therein laterally on each side of the vertical central plane and extending substantially parallel with said supply air channel and disposed in a region of a flat, horizontally extending ceiling of the room;

said supply air channel and said discharge air channel being disposed and configured so that at both sides of the passage region there is formed an air roll by which the supply air which is heated in a region of the work tables moves in a vertical direction into the region of the ceiling of the room to traverse through said slot-shaped, lateral suction openings into said discharge air channel, said supply air channel being formed from one of a substantially air-tight flexible textile material or a flexible plastics material, said circular air discharge openings being formed as a microperforation having said circular air discharge openings formed in said first and second lateral air supply portions, said circular air discharge openings of said microperforation having a diameter in a range between 0.1 and 1 mm.

2. The configuration according to claim 1, wherein said supply air channel has a D-shaped cross-section with a flattened region adjacent the ceiling of the room and a rounded side thereof facing the passage region.

3. The configuration according to claim 1, wherein said two slot-shaped suction openings of said discharge air channel for producing a substantially constant reduced pressure have an opening cross-section which expands from a fan-side end of said discharge air channel for incoming air.

4. The configuration according to claim 1, further comprising plate-shaped sound-absorbing elements received on the ceiling of the room, said plate-shaped sound-absorbing elements extending from the ceiling of the room as far as said two slot-shaped suction openings of said discharge air channel.

5. The configuration according to claim 1, wherein said supply air channel contains a fitting piece which can be replaced by at least one heat exchanger in order to additionally cool the supply air supplied.

6. The configuration according to claim 1, further comprising cooling members, at both sides of said supply air channel and with a predetermined spacing therefrom there is disposed one of said cooling members through which a cooling medium flows, said cooling members having a plurality of cooled air passage openings formed therein through which the air is directed from a region above said supply air channel in a direction toward a floor of the passage region.

7. The configuration according to claim 1, wherein said supply air channel has a light-permeable material; and further comprising a light source disposed within said supply air channel.

8. The configuration according to claim 1, further comprising a further discharge air channel disposed parallel with said discharge air channel, said further discharge air channel being a blind channel branching from a main discharge air channel which feeds said discharge air channel.

9. The configuration according to claim 1, wherein said circular air discharge openings of said microperforation have a diameter in a range between 0.4 to 0.6 mm.

10. The configuration according to claim 1, wherein said circular air discharge openings of said microperforation have a diameter of 0.5 mm.

11. The configuration according to claim 1, wherein the room is a laboratory room.

* * * * *